United States Patent [19]

Siminoff

[11] Patent Number: 4,515,059

[45] Date of Patent: May 7, 1985

[54] GEARED TUNING MACHINE

[76] Inventor: Roger H. Siminoff, 112 Privada Luisita, Los Gatos, Calif. 95030

[21] Appl. No.: 464,932

[22] Filed: Feb. 8, 1983

[51] Int. Cl.[3] ..... G10D 3/14

[52] U.S. Cl. ..... 84/306

[58] Field of Search ..... 84/305, 306, 267, 297, 84/304, 200, 204; 74/409

[56] References Cited

U.S. PATENT DOCUMENTS

| | | | |
|---|---|---|---|
| D. 210,981 | 5/1978 | Thompson | D56/1 |
| D. 216,049 | 11/1969 | Dreyer | D17/3 |
| 2,216,601 | 10/1940 | Nelson | 84/297 |
| 2,356,766 | 8/1944 | Kluson | 84/306 |
| 3,403,588 | 10/1968 | Downing | 84/306 |
| 3,431,807 | 3/1969 | Thompson | 84/306 |
| 3,564,573 | 2/1971 | Wustl | 84/306 |
| 4,014,239 | 3/1977 | Spercel | 84/306 |

*Primary Examiner*—L. T. Hix
*Assistant Examiner*—Douglas S. Lee
*Attorney, Agent, or Firm*—David B. Harrison

[57] ABSTRACT

A new type of tuning machine for a stringed musical instrument, such as a guitar, is disclosed. In order to permit the original instrument manufacturer, individual musicians or the local repair service to replace tuning machines without necessitating factory work and machining, a universal tuning machine configuration is utilized which will permit both left-hand and right-hand orientations. In addition, in order to accommodate the existing installation apertures and to avoid cosmetic alterations, a variety of mounting adaptor plates is provided to adapt the new unit to the old apertures.

10 Claims, 7 Drawing Figures

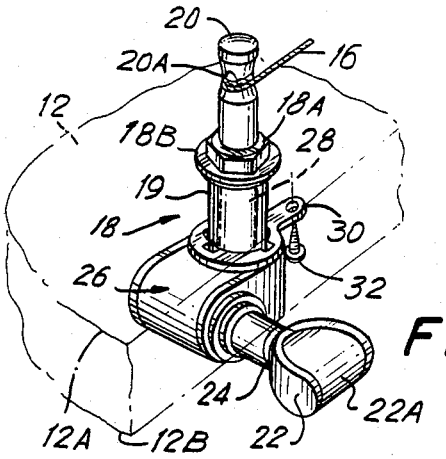
FIG.1a
FIG.1
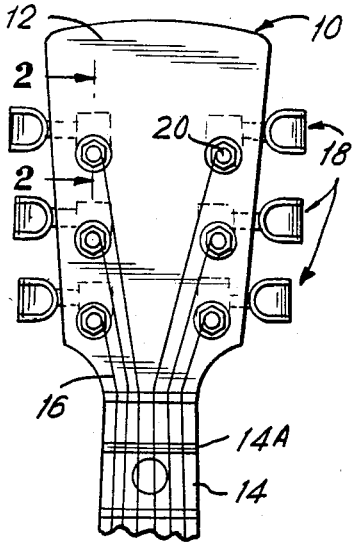
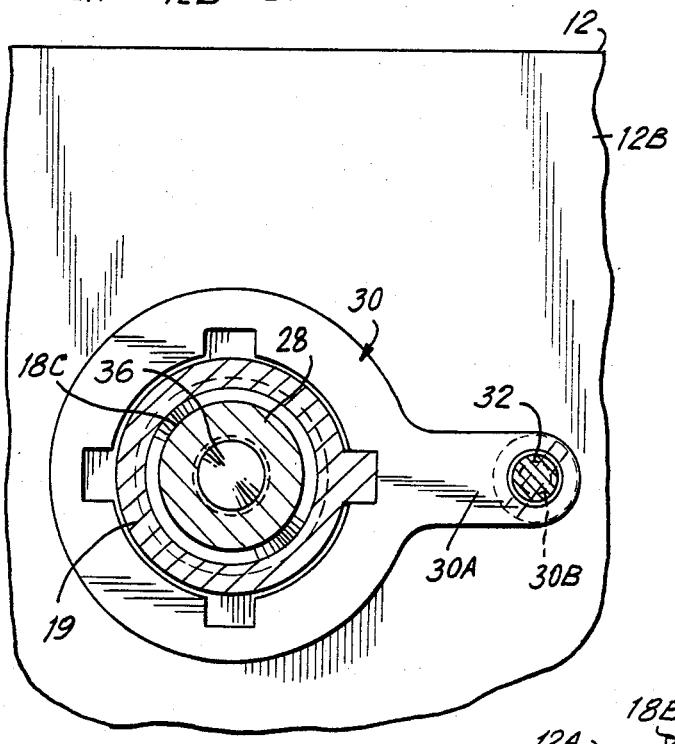
FIG.3
FIG.2
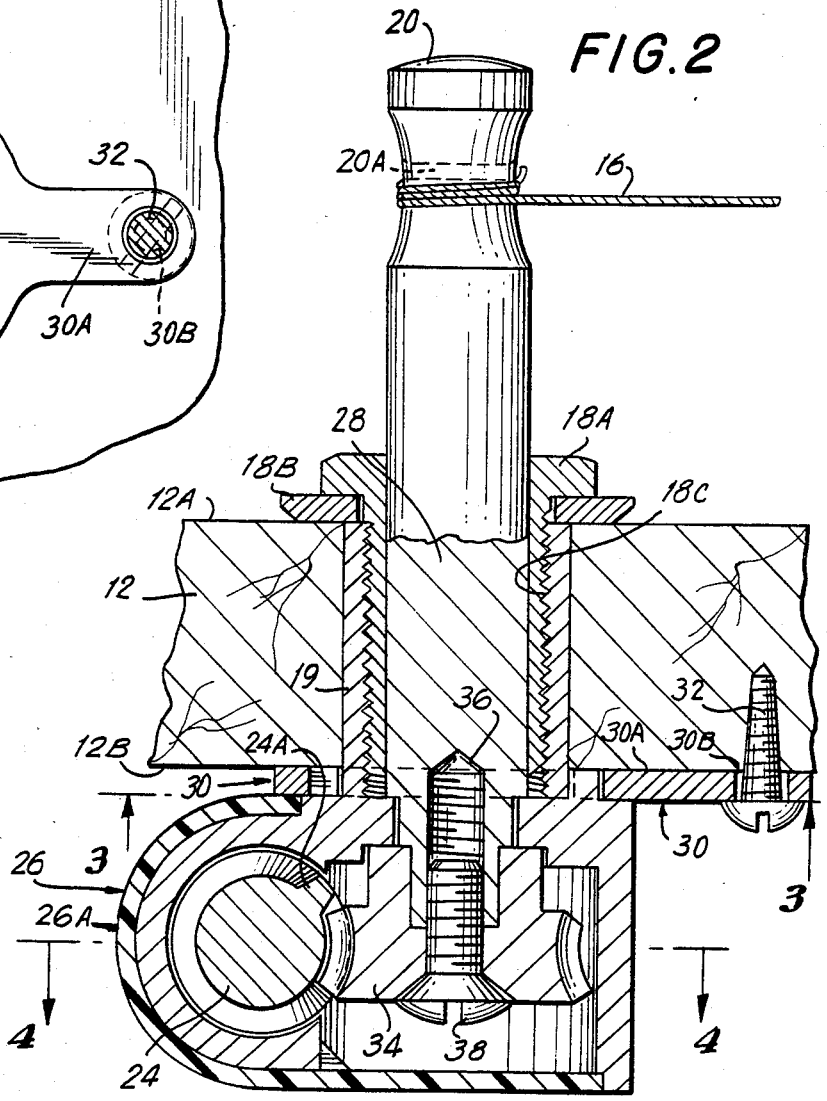

GEARED TUNING MACHINE

DESCRIPTION

This invention relates to musical instrument accessories in general, and to a new type of geared tuning machine for a stringed musical instrument in particular.

As the musical instrument field has developed rather intensively over the last several years, the widespread popularity of instruments among the average consumer has led to a veritable explosion of purchasing and playing of such instruments, together with increased composing of musical pieces and a heightened general appeal of music and its accoutrements. Numerous types of instruments have partaken of this popularity, but certainly stringed musical instruments rank quite high among the general population, and in particular, guitars, banjos and to a lesser extent, mandolins, are the leading stringed instruments in this category.

Along with the increased popularity of such instruments and their wide use, there has been a corresponding increase in repairing and servicing of the instruments by any of the many local repair shops specializing in these fields. The "do-it-yourself" practice in musical instrument repairs has also become more prevalent. There are, of course, various user-serviceable instrument components or jobs, such as replacement of strings, but when repairs may be called for on equipment such as the tuning machines which carry and adjust the strings, difficulties have frequently been encountered unless professional repair services are utilized.

Since the tuning machines take the tension of the string and are subject to constant adjustment and manipulation, and indeed are somewhat vulnerable at the end of the neck and on the peghead to possible abuse, it is often necessary to repair or replace them. Although tuning machines can be replaced with common procedures and simple tools, some obstacles—somewhat cosmetic in nature—are often encountered during the replacement procedure. Anyone who has performed this type of work is cognizant that prior tuning machines leave unsightly marks, such as their indentations or mounting holes, in the wood of the instrument. It is also of significance that on a typical six-string guitar or other stringed instrument, one must be prepared to install three left-handed (treble) and three right-handed (bass) replacement tuning machines (if all such machines are to be replaced), and accordingly, a full set of tuning machines typically includes three identical left-handed housings and three distinct but identical right-handed housings. Should the user or place of purchase have need to use only a portion of a set, there will remain one or a few housings of one specific orientation which may only be used for their specific right- or left-handed locations.

A similar problem encountered in the prior art is that some instruments require all six tuning machines to be of the same type, e.g., "treble" or "bass", which are generally installed as all left and all right machines, respectively. Since the machines are often sold with three of each kind in a set, a musician must either buy two full sets, or else convince a supplier to "break up" two sets to obtain six of one kind.

It can be definitely stated that instrument makers would derive additional benefits from tuning machines whose mountings provided them with the flexibility of several positions, directions, or orientations of their screw-lugs or bosses.

It is therefore an object of this invention to obviate one or more of the aforesaid difficulties.

It is also an object of this invention to provide replacement tuning machines designed to obscure prior tuning machines" attachment markings.

It is a further object of this invention to allow for end users to install a universal tuning machine replacement, irrespective of whether left-handed or right-handed pieces are required.

It is still another object of this invention to facilitate the ease of turning of the tuning knob which forms part of the tuning machine.

Additional objects and advantages of this invention, will become apparent when considered in conjunction with one particular illustrative embodiment of the invention wherein a geared tuning machine is shown which can replace factory installed tuning machines which are provided as part of a commercially manufactured guitar or other stringed instrument. The machine utilizes conventional worm gearing on a tuning shaft and on a corresponding rotatable gear-wheel portion which is attached to the string-carrying post. The relationship of the tuning shaft and the perpendicular post is such that the knob can project from the sides of the peghead of the guitar in either of two orientations, namely on one side with the string shaft in a right-handed orientation to the knob and on the other side with the shaft in a left-handed orientation. In this manner, the same machine may occupy either of two positions as may be needed in fulfilling a replacement function in a guitar.

The universality of the machine's housing is facilitated by having the mounting orientation of the housing be the same regardless of whether the housing is used on the left or right side of the peghead. Thus, the housing of the device can be symmetrical with respect to a center line running through the center of the housing and which is parallel to the longitudinal axis of the instrument. In either case, the tuning knob projects out perpendicular to the longitudinal axis just mentioned and the rotatable string post, perpendicular to the tuning knob, projects up through the existing aperture in the peghead. Because of the structure of the tuning machine, those machines on one side of the peghead will have their knobs arrayed in one uniform orientation with respect to the string post, while those on the opposite side will be similarly arrayed in a comparable but opposite orientation. In either event, the string posts will be able to receive the strings, which will then be adjustable in the normal fashion (as with a factory-fresh model), and will have their tuning knobs appropriately oriented outboard of the edge of the peghead.

As previously noted, it will frequently occur that the original tuning machine, which undoubtedly has been installed on the guitar for quite some time, often several years in duration, will leave a dent in the wood on the back of the peghead where the machine body has been present during that time. Moreover, the original tuning machine was installed with wood screws into holes which should not be left uncovered when a new tuning machine is to be installed. At the very least, such holes will be unsightly and could perhaps weaken the overall structure by being available to contamination and decay. The present invention overcomes that problem by providing several different shapes of mounting adaptor plates which fit over the string post collar and then are themselves screwed to the peghead piece. However, the variations in geometry of these plates is such that while they all are adapted to be engaged over the string post collar element, each of them has its attachment holes located in a somewhat different direction with respect to the main body of the tuning machine. This is to permit the user to select the appropriate plate to cover up and align with the previous tuning machine's embossments or markings and to permit the new screw hole to be aligned with at least one of the original screw hole locations. The user merely selects the appropriate adaptor plate and utilizes that in the replacement installation. The invention is designed to provide the user with cover plates whose shapes correspond to well-known and frequently used tuning machines, such as the "Schaller", "Kluson", "Grover" or other well-known brand of tuning machine. In this particular case, the shape of the plate will be precisely matched to the existing base, thereby covering up the previous indentations and markings and permitting the alignment of the "new" screw hole with one of the previously existing holes.

It has also been a problem in previous tuning machines to provide smooth turning of the knob so as to adequately control, in graduated amounts, the corresponding geared turning of the string post and thus properly control the tuning of the guitar. In order to facilitate the smooth turning of the knob, appropriate washers are provided at the extremities of the machine's housing to permit compression by the knob against the housing, thereby tending to smooth out the turning process for the knob by avoiding abrupt rotational "bursts" and limiting "sticky" relationships between the knob and the housing.

It is therefore a feature of an embodiment of this invention that a tuning machine for stringed musical instruments is provided with a universal mounting configuration to allow for left-handed or right-handed installation, depending only on the orientation of the tuning knob.

Another feature of an embodiment of this invention is that a varied selection of mounting adaptor plates are provided to receive the body of a tuning machine and also furnish a plate and screw hole portion to cover previous tuning machine markings and to be aligned with at least one pre-existing screw hole in the peghead of the instrument.

It is a further feature of an embodiment of this invention that mounting collars are provided at the junction of the tuning knob shaft and the tuning machine housing to allow for compression against a washer to enhance smoother turning of the knob shaft.

These and other objects, features and advantages of this invention will become more readily understood when considered in connection with a presently preferred, but nonetheless illustrative, embodiment of the invention, as explained in the following detailed description and as shown in the drawings, wherein:

FIG. 1 is a fragmentary plan view of part of a neck and peghead end of a typical six-string guitar carrying the tuning machines of this invention;

FIG. 1*a* is an enlarged perspective view of a tuning machine of this invention showing its mounting in one orientation with an illustrative version of its collar or mounting plate;

FIG. 2 is an enlarged side sectional view of the tuning machine and peghead support element of this invention, partly broken away, taken along the plane defined by the line 2—2 of FIG. 1 in the direction of the arrows;

FIG. 3 is an enlarged fragmentary bottom plan and sectional view of the adaptor plate of the tuning machine, taken along the line 3—3 of FIG. 2 in the direction of the arrow;

Figure 4:
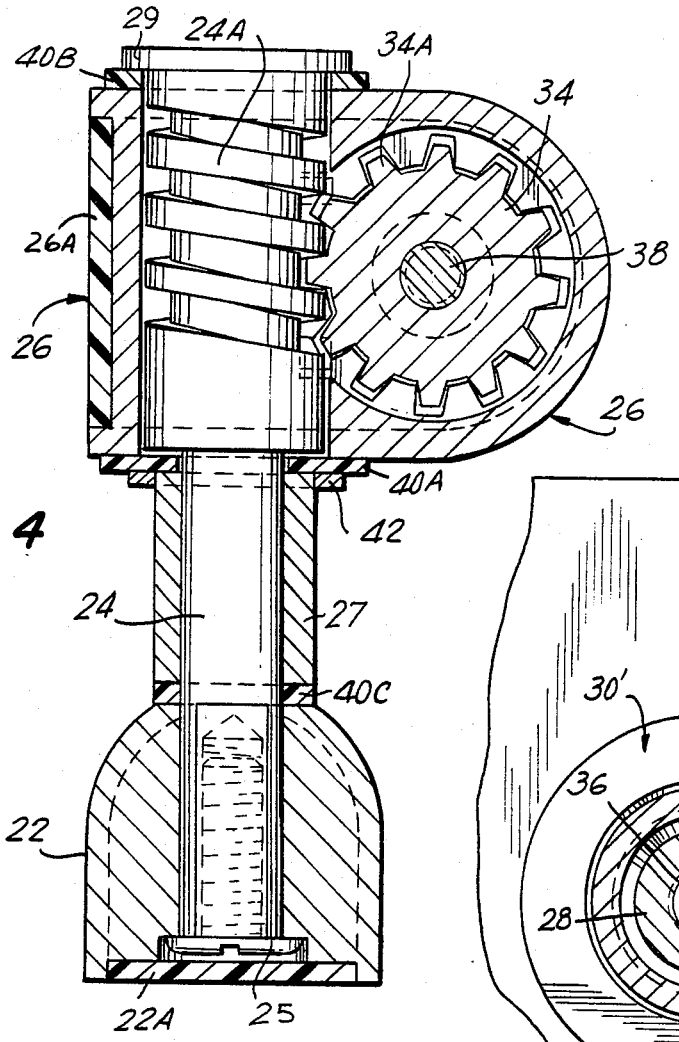
FIG. 4 is an enlarged sectional view of the tuning machine knob and shaft and the gearing arrangement thereof, taken along the line 4—4 of FIG. 2 in the direction of the arrows.

In the fragmentary view of FIG. 1, a typical peghead of a six-string musical instrument, such as a guitar, is illustrated. The guitar 10 is provided with peghead piece 12, which connects to the main portion of the guitar (not shown) through the neck portion 14. The neck carries the frets 14A over which the strings 16 pass to each of the tuning machines 18, and more particularly to the string posts 20 thereof. As shown in FIG. 1 for example, the three tuning machines 18 on the right side of peghead 12 can be considered to have a right-hand orientation, whereas those on the left side, having the same construction as the others, have a left-hand orientation. This would be a typical installation in a six-string guitar and would permit the three left and three right-handed tuning machines to be utilized with this invention.

To consider further the detailed aspects of the invention, reference should be had to FIGS. 1*a*, 2, 3 and 4. Thus, FIG. 1*a* shows a detailed perspective and enlarged view of one of the tuning machines of this invention, pictured in FIG. 1 and representing either the left-handed or the right-handed orientation. Tuning machine 18 in FIG. 1*a* is mounted on the upper surface 12A of peghead piece 12 by means of nut 18A and underlying washer 18B. Projecting upward from nut 18A is string post 20, through which passes bore 20A carrying string 16 which is appropriately knotted and tied. Beneath lower surface 12B of peghead piece 12 projects tuning knob 22, with cover piece 22A, and its corresponding shaft 24, to which the knob 22 is removably attached by a threaded screw 25 which engages mating threads formed in an interior end opening of the shaft 24 as shown in FIG. 4. The shaft 24 enters into main body portion of the tuning machine housing 26. A tubular spacer bushing 27 is slipped over the shaft 24 after it has been seated through the housing 26, and the spacer bushing 27 may include a flange 42 for engaging a sidewall portion of the housing 26 adjacent a journal opening for the shaft 24. An end collar 29 is formed at the end of the shaft 24 opposite to the knob end thereof, and the collar 29 engages another sidewall portion of the housing 26 adjacent another journal opening for the shaft 24. Three semi-rigid washers 40A, 40B, and 40C are interposed respectively between the spacer bushing 27 and the housing 26, the collar 29 and the housing 26, and the knob 22 and spacer bushing 27. The tuning machine is installed through the aperture in peghead piece 12 and cylindrical housing piece 28 is carried in such aperture, linking string post 20 with the gearing (see FIG. 4) within the machine's housing 26.

The attachment of tuning machine 18 to peghead end 12 is achieved at opposite surfaces 12A and 12B in the following manner. At the upper end, as has already been noted, nut 18A is tightened down onto washer 18B. But at the lower end 12B, one of several adaptor plates 30 is utilized. In the particular embodiment illustrated in FIG. 1*a*, adaptor plate 30 is installed over shaft 28 and has its aperture 30B (see FIGS. 2 and 3) set at an orthogonal orientation to tuning knob 22 and corresponding shaft 24. This permits tapered screw 32 to be inserted in an upward direction (FIGS. 1*a* and 2) to penetrate into an existing hole in bottom surface 12B of peghead piece 12.

Considering the views of FIGS. 1*a* and 2–4 together, the operation of this inventive structure can be understood. As the knob 22 (FIGS. 2 and 4) is rotated in one direction or the other, the worm gear relationship illustrated in FIG. 4 results in the corresponding rotation of string post 20. For example, if knob 22 and thus shaft 24 are rotated in a clockwise direction, this results in the generally "forward" turning of worm gear members 24A, thus leading to the clockwise rotation of circular worm gear-wheel member 34. This member, which meshes with worm gear segments 24A at corresponding segments 34A, is coupled to string post 20 by means of underlying bolt 38 which is accommodated within bolt hole 36 at the bottom of string post 20. Thus, the fixed relationship between circular worm gear-wheel member 34 and string post 20 causes the appropriate "follower" motion of the worm gear-wheel member 34. This gearing arrangement is generally conventional and is not, per se, part of this invention.

However, it should be appreciated from the views of FIGS. 1*a*, 2 and 4, considered together, that the orientation of tuning machine 18 can be changed to the opposite side of peghead 12, without changing its operativeness or relative positioning between knob 22 and string post 20, i.e., that the tuning knob 22 and its corresponding shaft 24 will project out in a direction 180° away from that shown in FIG. 1*a*, but with string post 20 still occupying the upright perpendicular relationship shown in FIG. 1*a*; and because string 16 will be tied through hole 20A in a similar fashion from the opposite side of peghead piece 12 (not specifically illustrated), the turning relationship between knob 22 and string post 20 can be maintained the same, within the structural context of the tuning machine 18, except that the left-handed relationship between FIG. 1*a* is replaced by a right-handed relationship. This reversal is accomplished by removing cover 22A, screw 25 and knob 22; slipping the spacer bushing 27 and washers 40A and 40C off of the shaft 24; removing the shaft 24 from the housing 26 at the collar end of the shaft 24. The shaft 24 is then reinserted into the housing in opposite orientation with the collar 29 now engaging the sidewall formerly engaged by the spacer bushing 27. The washers 40A and 40C, together wih the spacer bushing 27 are slipped over the shaft 24; the knob 22 is reinstalled, and the screw 25 is then threaded into the shaft 24 to lock the shaft in place in its reversed orientation. It is therefore apparent that the structure of this tuning machine 18 can occupy a position on either side of peghead piece 12 and still function in an identical fashion to permit the tightening or loosening of a string 16 by means of controlled rotation of string post 20 under the influence of tuning knob 22 and its corresponding shaft 24. The advantages of this interchangeable orientation are significant in that only one type of tuning machine needs to be purchased by a consumer or other end user who is called upon to replace an existing machine which may originally have been of the left-handed or right-handed variety. The tuning machine 18 of this invention can be used to replace either of those types.

Although the drawings shown here do not present an actual view of a previous tuning machine which has been replaced on a given peghead, it can be visualized from FIG. 1*a* and also from FIG. 1, that a pre-existing factory-installed tuning machine formerly occupied the general position now occupied in FIG. 1*a* by tuning machine 18. However, significant differences should be indentified, namely that the previous tuning machine will undoubtedly have left indentations or other markings where its main body portion contacted the underside 12B of peghead end 12. In installing the new tuning machine 18 as shown in FIG. 1*a*, for example, the main body portion 26 of the tuning machine does not entirely obscure whatever indentations or markings may have been present from the previous tuning machine. In order to provide such a desirable covering, plate 30 is utilized around shaft 28 and above main body portion 26 of the tuning machine.

The installation technique can be illustrated in enlarged sectional view in FIG. 2, whereby tapered wood screw 32 is inserted through aperture 30B in plate 30 and attaches into peghead piece 12, generally constructed of wood. Considering the perspective view of FIG. 1*a*, as well as the bottom plan view of FIG. 3, it can be appreciated that the surrounding main body portion of plate 30 serves to cover over or obscure any correspondingly underlying markings which may have appeared immediately around the formerly depending body portion of the previous tuning machine. Generally speaking, these would be markings in the lower surface 12B of peghead piece 12, although other markings could also appear on the upper surface 12A. But as noted in FIG. 1*a* and also in FIG. 3, the surrounding portion of adaptor plate 30 obscures whatever areas surrounded the immediate central portion of the tuning machine.

At the same time, the former tuning machine was coupled to the lower surface 12B of the peghead end by means of various screw holes (not shown), but which are of known dimensions with respect to the vertical center line of the new tuning machine, which fills the bored hole through the peghead 12. As a result, it will be noted that plate 30 in FIG. 1*a* is rotatable about mounting sleeve 19 and can occupy the orientation shown in FIG. 1*a* or else can be rotated in a counterclockwise direction to occupy any other appropriate position through 180° of travel in that rotation. As such, screw hole 30B can be lined up with any existing hole in the lower surface 12B of peghead end 12. In this manner, the previous hole utilized to mount the former tuning machine can be re-used and the unsightly indentations or markings from the previous tuning machines body can at the same time be obscured by the proper positioning of mounting plate 30. This, then, is also an advantage to the guitar or other instrument manufacturer, who also can select desired positions or orientations for the adaptor plates to suit a variety of tastes and design styles.

In order to achieve a versatility in adapting the tuning machine of this invention to any of a variety of replacement installations for other tuning machines, a comparable variety of adaptor plates of the type shown at 30 is provided. Two other illustrative variations are shown, including 30′ in FIG. 5 and 30′ in FIG. 6. Considering plate 30′ in FIG. 5, it will be noted that whereas aperture 30B of plate 30 is on a diametrical longitudinal line for that plate, hole 30′ B is offset from a longitudinal diametrical line for cover plate 30′ (FIG. 5) and is therefore capable of being aligned with other and differently located existing screw holes which had been used to install previously and about to be replaced tuning machines.

Figure 5:
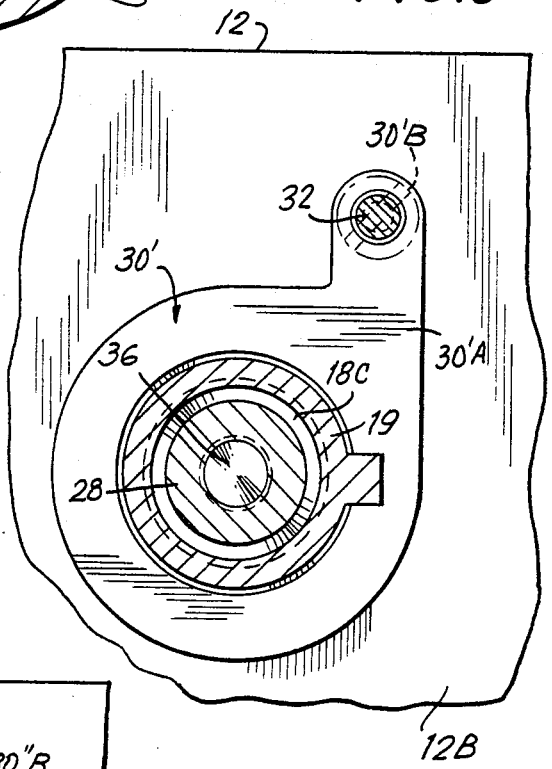
FIG. 5 is a view similar to that of FIG. 3 but showing an alternate adaptor plate.
Figure 6:
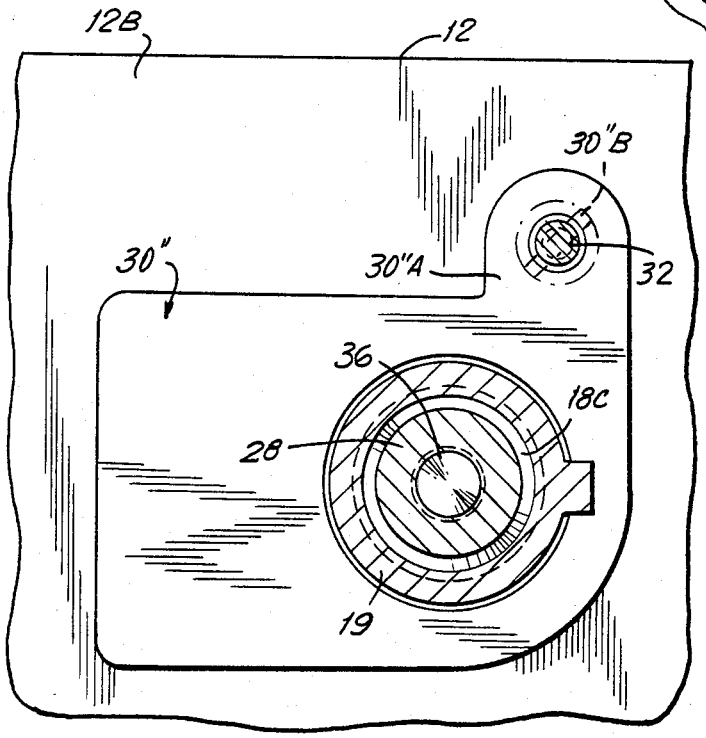
FIG. 6 is another view similar to that of FIG. 3 and showing still another alternate adaptor plate.

The obscuring or disguising of pre-existing indentations or markings from a previous tuning machine is also achieved somewhat differently with the adaptor plate 30′ of FIG. 5, because of the more substantial connecting portion 30′ A leading to aperture 30′ B. And in a further similar vein, adaptor plate 30′ of FIG. 6 carries still another orientation with a substantially rectangular left end portion opposite where arm 30′ A connects to apertured portion 30′ B. With the variety of configurations and geometries represented by plates 30, 30′ and 30″ in FIGS. 3, 5 and 6 respectively, a substantial number of the undesired indentations and blemishes remaining from previous tuning machines, and known to have particular shapes because of the common usage of such machines, can be blocked out by these adaptor plates of the present invention.

Another problem encountered in tuning machines is the difficulty on occasion of turning the knobs and the possible "sticking" of the shafts which lead to the gearing apparatus. Another expedient of the present invention which tends to eliminate this abrupt and disconcerting sticking of the knob and shaft (22 and 24 in FIG. 1*a*) is the presence of washers 40A, 40B and 40C illustrated in FIG. 4. Abutting washer 40A toward the tuning knob end is a collar or lip 42. Washers 40A, 40B and 40C tend to be in compression as tuning knob 22 turns, thus turning shaft 24 which forces engaged gearing members 24A and 34A to mesh and turn. In order to "soften" and distribute the forces associated with the turning action, the presence of washers 40A, 40B and 40C which may be made of nylon, fiber or other suitable semi-rigid material, permits an ease of turning between shaft 24 and main body portion 26 which will tend to inhibit or even eliminate any stickiness in turning and any difficulty which would otherwise interfere with the proper string adjustment and thus tuning of the instrument.

It should be appreciated that the foregoing description is based on specific structural embodiments and that numerous changes may be made in the details of the apparatus disclosed herein to accommodate variations within the skill of the art, without departing from the spirit and scope of the invention.

What is claimed is:

1. A universal tuning machine for tuning a string of a stringed musical instrument, said machine comprising:

a. a two-part housing including a base and threaded flange means for threading onto mating threads of said base so as to mount said machine in an opening formed through a peghead portion of said stringed musical instrument;

b. a string post rotationally journalled through and aligned by said flange means for engaging said string to be tuned;

c. a worm gear-wheel member attached to said post and housed in a cavity defined by said housing;

d. a demountable rotatable tuning shaft journalled through a pair of aligned apertures defined by opposite sidewalls of said housing, said shaft including a collar at one end thereof extending beyond said housing for engaging a first semi-rigid washer bearing against an adjacent outer surface of a said sidewall, said shaft including a worm gear segment adapted for meshing with said worm gear-wheel member and for causing it to rotate as said shaft is rotated, said shaft further including a knob extension portion extending from said housing opposite from said collar;

e. removable tubular spacer bushing means placed over said knob extension portion of said tuning shaft and including a lip engaging a second semi-rigid washer bearing against an adjacent outer surface of said other sidewall, said spacer bushing means for retaining said shaft in proper alignment with said housing;

f. tuning knob means removably attached to the end of said knob extension portion of said shaft for enabling said shaft to be rotated, said tuning knob means including an inner surface engaging a third semi-rigid washer bearing against an adjacent surface of said tubular spacer bushing means;

whereby said shaft may be installed in two opposed orientations relative to said housing and along the same axis of rotation and further whereby said first, second and third semi-rigid washer means coact to inhibit stickiness in turning said tuning shaft by manipulating said knob means.

2. The universal tuning machine as set forth in claim 1 wherein said housing is symmetrical about a plane of symmetry, an axis of rotation of said tuning post lying within said plane, and an axis of rotation of said shaft being perpendicular with respect to said plane.

3. The universal tuning machine as set forth in claim 1 and further comprising a plurality of adaptor plates, each said plate being adapted to cover an imprint on said peghead left by a particular previously used tuning machine, each said adaptor plate including a mounting aperture enabling said plate to be mounted between said housing and said peghead, keying means for engaging like keying means of said housing to maintain alignment of said housing and said plate, and an attachment aperture for securing said plate to said peghead so that said plate covers said imprint and secures said housing in proper alignment relative to said peghead.

4. The universal tuning machine as set forth in claim 1 wherein said housing is adapted to receive cover means for covering said worm gear segment and said cavity containing said worm gear-wheel member, and further comprising cover means for snap-locking, removable engagement with said housing.

5. A tuning machine in accordance with claim 1 wherein said peghead has an upper surface through which projects said string post and a lower surface from which projects said housing and said tuning knob means and said shaft, and including in addition adaptor means for mounting between said housing and said lower surface of said peghead to conceal at least a portion of said lower surface of said peghead.

6. A tuning machine in accordance with claim 5 wherein said portion of said lower surface of said peghead has at least one blemish attributable to the presence of a previously used tuning machine, and said adaptor means includes a plate having a main body portion, a mounting aperture and an attachment aperture for securing said plate to said lower surface of said peghead above said housing and disposed such that said main body portion of said plate covers said blemish.

7. A tuning machine in accordance with claim 6 including a mounting sleeve between said housing and said upper surface of said peghead, said mounting aperture of said adaptor means having a configuration to mate with said mounting sleeve and being rotatable therearound for selective positioning in a plurality of locations about a fixed center.

8. A tuning machine in accordance with claim 7 wherein said attachment aperture is aligned with an aperture in said lower surface of said peghead attributable to said previously used tuning machine, and said main body portion is generally circular in shape with a diametrically aligned segment containing said attachment aperture therein.

9. A tuning machine in accordance with claim 7 wherein said attachment aperture is aligned with an aperture in said lower surface of said peghead attributable to said previously used tuning machine, and said main body portion is generally circular in shape with a tangentially aligned segment containing said attachment aperture therein.

10. A tuning machine in accordance with claim 7 wherein said attachment aperture is aligned with an aperture in said lower surface of said peghead attributable to said previously used tuning machine, and said main body portion is generally rectangular in shape with an orthogonal end portion projecting therefrom and containing said attachment aperture therein.

* * * * *